US005482666A

United States Patent [19]

Larsson

[11] Patent Number: 5,482,666

[45] Date of Patent: Jan. 9, 1996

[54] MANUFACTURE OF FIBERBOARD BY INDEPENDENTLY CONTROLLING TEMPERATURE AND MOISTURE CONTENT

[75] Inventor: Arne Larsson, Karlstad, Sweden

[73] Assignee: Sunds Defibrator Industries Aktiebolag, Sweden

[21] Appl. No.: 192,490

[22] Filed: Feb. 7, 1994

[30] Foreign Application Priority Data

Sep. 15, 1993 [SE] Sweden ..... 9302993

[51] Int. Cl.[6] ..... B27N 3/04

[52] U.S. Cl. ..... 264/115; 264/109; 264/121; 264/123; 156/62.2; 156/62.4

[58] Field of Search ..... 264/109, 112, 264/113, 115, 118, 121, 123; 425/89; 156/62.2, 62.4

[56] References Cited

U.S. PATENT DOCUMENTS

| | | | |
|---|---|---|---|
| 2,872,337 | 3/1959 | Heritage et al. | 264/121 |
| 4,404,250 | 9/1983 | Clarke | 156/62.4 |
| 4,862,599 | 9/1989 | Brunner | 34/46 |

FOREIGN PATENT DOCUMENTS 462707 8/1990 Sweden .

*Primary Examiner*—Robert A. Dawson
*Assistant Examiner*—Kenneth M. Jones
*Attorney, Agent, or Firm*—Lerner, David, Littenberg, Krumholz & Mentlik

[57] ABSTRACT

Methods of manufacturing fiberboard from lignocellulose-containing fibrous material are disclosed including defibering the lignocellulose-containing material, drying the defibered lignocellulose-containing material by contact with a heated drying gas in a first drying step to produce a partially dried lignocellulose-containing material, mixing the partially dried lignocellulose-containing material with a glue, drying the admixture of partially dried lignocellulose-containing material and glue by contact with a heated drying gas in a second drying step, which is conducted at a lower temperature than the first drying step, independently controlling the temperature and moisture content in the second drying step to produce a dried lignocellulose-containing material having a predetermined temperature and moisture content, forming the dried lignocellulose-containing material into a fiber mat, and hot pressing the fiber mat into fiberboard.

6 Claims, 1 Drawing Sheet

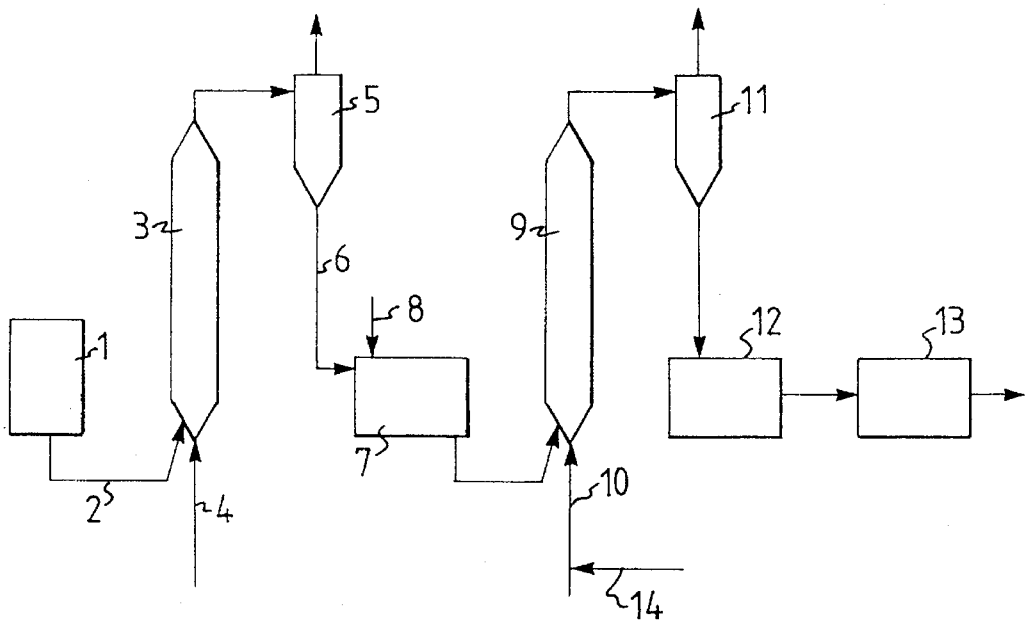
1
2
3
4
5
6
7
8
9
10
11
12
13
14

MANUFACTURE OF FIBERBOARD BY INDEPENDENTLY CONTROLLING TEMPERATURE AND MOISTURE CONTENT

FIELD OF THE INVENTION

The present invention relates to the manufacture of fiberboard. More particularly, the present invention relates to manufacturing fiberboard from lignocellulose-containing fibrous material utilizing the dry method. Still more particularly, the present invention relates to manufacturing fiberboard from lignocellulose-containing fibrous material such as wood, straw and bagasse using the dry method of manufacture therefor.

BACKGROUND OF THE INVENTION

During the manufacture of fiberboard in accordance with the dry method, the raw material is generally disintegrated by defibering, and the defibered material is then normally dried with drying gas in one or more steps, and glued. The dried material is then formed into a fiber mat, which is then hot pressed to provide a finished board. Multi-layer fiberboard is manufactured in a corresponding manner.

The addition of glue is required in these processes in order to provide a fiberboard having sufficient strength. The glues utilized for this purpose are normally thermosetting glues, such as urea resins or phenolic resins.

During these known fiberboard manufacturing methods, the glue is mixed with the fiber material after its defibration, and the material is then dried with hot air. The hot air so utilized generally has a high ingoing temperature, for example, of about 160° C., so that during the drying process the glue can become undesirably overheated, and thus harden, at various locations, causing the hardened glue to lose its adhesive capacity. In order to then compensate for this loss of effectively active glue, excessive amounts of glue must therefore be added, which, in turn, results in a significant cost increase due to the required unnecessarily high glue consumption. The cost of the glue thus constitutes one-quarter to one-third of the total cost of the finished fiberboard, thus resulting in a considerable increase in the overall manufacturing cost, and a corresponding deterioration of the manufacturing economy.

In another method of fiberboard manufacture, the fiber material is first dried in a drier with a high temperature drying gas, for example at about 200° C. The dried fibers leaving the drier are then mixed with glue in a mixer. During this admixture, the glue is mixed with an approximately equal amount of water. The addition of glue is in the magnitude of about 10% of the dry weight of the ready mixture. In order to compensate for the water which is added with the glue, the fibers must therefore be correspondingly overdried. This overdrying, however, causes the fibers to become too dry, and thus have a poor adhesive capacity to the added glue. Instead of being uniformly distributed over the fibers, portions of the glue will therefore form small lumps distributed within the fiber material, or so-called glue spots. This non-uniform distribution of the glue must therefore be compensated for by an increase in the glue addition, which results in a deterioration of the quality of the finished fiberboard.

Another prior art variation of the dry method of fiberboard production is set forth in Swedish Patent No. 462,707. This patent discloses a method in which fiberboard is manufactured using two drying steps with intermediate mixture with a binding agent, and in which the second drying step is conducted at a lower temperature than the first drying step.

U.S. Pat. No. 5,034,175 discloses yet another process for manufacturing fiberboard which, in this case, discloses a two-stage drying method which includes transferring the dried lignocellulose-containing material from the drying steps directly to a forming station where the fiber web is formed and in which the temperature of the dried lignocellulose-containing material is maintained during that transfer.

SUMMARY OF THE INVENTION

In accordance with the present invention, an improved method for manufacturing fiberboard from lignocellulose-containing fibrous material has been invented which includes defibering the lignocellulose-containing material, drying the defibered lignocellulose-containing material by contacting it with a heated drying gas at a first predetermined temperature in a first drying step to produce a partially dried lignocellulose-containing material, mixing the partially dried lignocellulose-containing material with a glue, drying the admixture of the partially dried lignocellulose-containing material and the glue by contacting the admixture with a heated drying gas at a second predetermined temperature in a second drying step, the second predetermined temperature being less than the first predetermined temperature, independently controlling the temperature and moisture content of the lignocellulose-containing material in the second drying step so as to produce a dried lignocellulose-containing material having a predetermined temperature and moisture content, forming the dried lignocellulose-containing material into a fiber mat, and hot pressing the fiber mat into fiberboard.

In accordance with one embodiment of the method of the present invention, the method includes admixing a glue to the defibered lignocellulose-containing material prior to the first drying step.

In accordance with another embodiment of the method of the present invention, the first drying step includes a first dwell time and the second drying time includes a second dwell time, the second dwell time being less than the first dwell time.

In accordance with another embodiment of the method of the present invention, the independent controlling of the temperature and moisture content of the lignocellulose-containing material in the second drying step comprises the addition of steam and water, respectively, to the heated drying gas therein. In a preferred embodiment, the predetermined temperature of the dried lignocellulose-containing material is between about 20° and 80° C. In another preferred embodiment, the predetermined moisture content of the dried lignocellulose-containing material is between about 5 and 15%.

BRIEF DESCRIPTION OF THE FIGURE

The following detailed description of the present invention may be more fully appreciated with reference to the FIGURE, which shows a schematic flow chart of a plant for the manufacture of fiberboard according to the present invention.

DETAILED DESCRIPTION

Referring to the FIGURE, the plant shown in the FIGURE comprises a refiner 1 for defibering the lignocellulose-containing fiber material. The defibered lignocellulose-containing fiber material is then directed through a blow line 2 to a first drying step 3, which utilizes, for example, a tubular drier therefor. While being dried in drying step 3, the fiber material is transported at the same time by hot drying gas which is added through a supply line 4. After the drying step 3, the drying gas is separated from the partially dried lignocellulose-containing material in a first cyclone 5, while the fiber material is directed through a line 6 to a mixer 7 for the admixture of thermosetting glue, such as a urea resin or a phenolic resin. The glue is supplied thereto through an inlet 8.

The glued fiber material is then introduced from the mixer 7 to a second drying step 9, which can again utilize a tubular drier, or a drier of a simpler design. The temperature in the second drying step is kept lower than the temperature in the first drying step, and, in addition, the drying period or dwell time in the second drying step is shorter than the drying period in the first drying step. During the drying process, the fiber material is transported by a hot drying gas supplied through an inlet 10. The fiber material and the gas are transferred from drying step 9 to a second cyclone 11, where the gas is separated from the dried lignocellulose-containing material, and that fiber material is directed to a subsequent forming station 12, where it is formed into a fiber mat, which thereafter is pressed in a hot press 13 to form the fiberboard. The drying gas supplied through line 10 to the second drying step 9 is conditioned by controlled spray-in of steam and, respectively, water through a separate supply line 14.

By substantially carrying out the drying process in a first drying step 3 by means of a drying gas at a high temperature, and subsequently glueing the fiber material, and then in a second drying step 9 finally controlling the drying by utilizing a drying gas at a lower temperature, it has been found to be possible to reduce the need for additional glue being employed, while at the same time maintaining the strength of the finished fiberboard. These results can be obtained even if a portion of the glue has been added in the blow line 2, after defibration. In both cases, the emissions of formaldehyde from the process are also reduced.

The method of this invention thus makes it possible to control in the second drying step 9, within certain limits, the temperature and moisture content of the fiber material independently of each other, and therefore to determine the temperature and moisture content of the formed fiber mat independently of each other. Such control is effected by the nature of the drying gas supplied, the temperature and moisture content of which is controlled by the addition of steam and, respectively, water thereto. The fiber material, as it is discharged from the drying step 9, can thus possess a desired temperature, preferably within the range of from about 20° to 80° C., while at the same time the moisture content is determined, independently of the temperature, to a value of from about 5 to 15%.

By controlling the temperature and moisture content of the fiber material independently of each other within certain limits in this manner, suitable values for each of these parameters can be set, depending on the type of fiberboard which is to be produced. Some of the factors which will have an effect thereon are the quality of the fiber material, the type of glue used, and the manner in which the forming and pressing steps are carried out. It can be especially advantageous, for example, to be able to form a fiber mat at an increased temperature, but without lowering the moisture content.

It has also been found that the consumption of glue can be additionally reduced, and the strength of the fiberboard can be maintained, by a suitable selection and control of the temperature and moisture content of the fiber material in the second drying step.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. A method of manufacturing fiberboard from lignocellulose-containing fibrous material comprising defibering said lignocellulose-containing material, drying said defibered lignocellulose-containing material by contacting said lignocellulose-containing material with a heated drying gas at a first predetermined temperature in a first drying step to produce a partially dried lignocellulose-containing material, mixing said partially dried lignocellulose-containing material with a glue, drying said admixture of said partially dried lignocellulose-containing material and said glue by contacting said admixture with a heated drying gas at a second predetermined temperature in a second drying step, said second predetermined temperature being less than said first predetermined temperature, independently controlling the temperature of said lignocellulose-containing material in said second drying step and controlling said moisture content of said lignocellulose-containing material by the addition of moisture, where necessary, to said heated drying gas at a second predetermined temperature, so as to produce a dried lignocellulose-containing material having a predetermined temperature and moisture content, forming said dried lignocellulose-containing material into a fiber mat, and hot pressing said fiber mat into said fiberboard.

2. The method of claim 1 including admixing a glue with said defibered lignocellulose-containing material prior to said first drying step.

3. The method of claim 1 wherein said first drying step includes a first dwell time and said second drying step includes a second dwell time, said second dwell time being less than said first dwell time.

4. The method of claim 1 wherein said independent controlling of said moisture content of said lignocellulose-containing material in said second drying step comprises the addition of moisture in a form selected from the group of steam and water to said heated drying gas therein.

5. The method of claim 4 wherein said predetermined temperature of said dried lignocellulose-containing material is between about 20° and 80° C.

6. The method of claim 4 wherein said predetermined moisture content of said dried lignocellulose-containing material is between about 5 and 15%.

* * * * *